US005239153A

United States Patent [19]

Beckett

[11] Patent Number: 5,239,153

[45] Date of Patent: Aug. 24, 1993

[54] DIFFERENTIAL THERMAL HEATING IN MICROWAVE OVEN PACKAGES

[75] Inventor: Donald G. Beckett, Mississauga, Canada

[73] Assignee: Beckett Industries Inc., Oakville, Canada

[21] Appl. No.: 841,286

[22] Filed: Feb. 28, 1992

Related U.S. Application Data

[63] Continuation of Ser. No. 442,153, Nov. 28, 1989, abandoned.

[30] Foreign Application Priority Data

Nov. 28, 1988 [GB] United Kingdom ..... 8827709

[51] Int. Cl.[5] ..... H05B 6/64

[52] U.S. Cl. ..... 219/10.55 E; 219/10.55 F; 219/10.55 R; 99/DIG. 14; 426/107; 426/234; 426/243; 156/634; 156/640

[58] Field of Search ..... 219/10.55 E, 10.55 F, 219/10.55 R; 426/107, 109, 234, 241, 243; 99/DIG. 14; 126/390; 428/34; 156/640, 345, 634

[56] References Cited

U.S. PATENT DOCUMENTS

| | | | |
|---|---|---|---|
| 4,015,085 | 3/1977 | Woods | 219/10.55 E |
| 4,398,994 | 8/1983 | Beckett | 156/635 |
| 4,552,614 | 11/1985 | Beckett | 156/640 |
| 4,610,755 | 9/1986 | Beckett | 156/634 |
| 4,641,005 | 2/1987 | Seiferth | 219/10.55 E |
| 4,685,997 | 8/1987 | Beckett | 156/629 |
| 4,876,427 | 10/1989 | Mode | 219/10.55 F |
| 4,882,463 | 11/1989 | Kyougoku et al. | 219/10.55 F |
| 4,883,936 | 11/1989 | Maynard et al. | 219/10.55 F |
| 4,936,935 | 6/1990 | Beckett | 156/239 |
| 4,940,867 | 7/1990 | Peleg | 219/10.55 E |
| 4,959,516 | 9/1990 | Tighe et al. | 219/10.55 E |
| 4,962,000 | 10/1990 | Emslander et al. | 219/10.55 E |
| 4,963,424 | 10/1990 | Beckett | 428/209 |
| 4,985,606 | 1/1991 | Faller | 219/10.55 E |
| 5,039,364 | 8/1991 | Beckett et al. | 156/60 |

*Primary Examiner*—Bruce A. Reynolds
*Assistant Examiner*—Tu Hoang
*Attorney, Agent, or Firm*—Sim & McBurney

[57] ABSTRACT

Packaging structures for the microwave cooking of foodstuffs are described which are formed from laminates which have an outer polymeric film layer, an outer support layer and a thin layer of electroconductive material between the outer layers of a thickness effective to produce thermal energy when exposed to microwave radiation. The laminate also incorporated one or more additional layers of material which result in differential degrees of heating being obtained from the thin layer of electroconductive material upon exposure of the packaging structure to microwave radiation. Specific examples of a pot pie dish and a pizza heating board are described.

35 Claims, 4 Drawing Sheets

DIFFERENTIAL THERMAL HEATING IN MICROWAVE OVEN PACKAGES

This is a continuation of co-pending application Ser. No. 442,153 filed Nov. 28, 1989, now abandoned.

FIELD OF INVENTION

The present invention relates to packaging structures used in the microwave cooking of foodstuffs for consumption, wherein differential degrees of thermal heating are obtained from different parts of the package by manipulation of the various layers of material within a laminate from which the packaging structure is formed.

BACKGROUND TO THE INVENTION

The use of microwave energy to reheat or cook food products for consumption is increasing. With certain food products, particularly those with an exterior crust, the result often is not acceptable, since the crust is not crispened.

It is well known, for example, from U.S. Pat. No. 4,641,005, that a thin metallic film may be employed to convert a portion of microwave energy incident thereon into thermal energy, and that such thermal energy may be employed to effect crispening or browning of the crust of a foodstuff being heated by microwave energy.

A number of applications of such technology have been proposed but, as a general rule, the thermal energy production has been one-dimensional, in the sense that the same thermal output is obtained from all the regions of the packaging structure where the thin metal film is located.

Having regard to the nature of certain food products, this uniform heat generation may be unsatisfactory and may lead to uneven cooking of the food when exposed to microwave radiation, as typically occurs with pizza.

SUMMARY OF INVENTION

In accordance with the present invention, the prior art problem referred to above is overcome by providing a novel packaging structure wherein differential degrees of thermal heating are obtained from different parts of the package by the appropriate choice of the various layers of material within a laminate structure from which the packaging material is formed.

The choice and number and location of the various possible layers depends on the intended use of the packaging structure, the foodstuff to be heated and the degree and manner of differential heating required. However, from the following description of the invention, it will become apparent to those skilled in the art how to make the appropriate choice for the particular situation.

The present invention is applicable to a wide variety of packaging structures which can be used to cook foodstuffs by the application of microwave energy. The actual physical form of the structure is dependent on the foodstuff chosen and the manner of microwave energy cooking which it is desired to apply thereto. For example, the packaging structures may take the form of a bag-like enclosure, an open-topped tray or a planar board-like structure.

In all embodiments of the invention, there is provided a laminate structure having a non-electroconductive support substrate, preferably paper or paperboard, at least one thin electroconductive material layer, usually metal, having a thickness such that at least a portion of microwave energy incident thereon is converted into thermal energy, adhered by an adhesive layer to the substrate layer.

The thermal energy which is produced by the laminate differs in different portions of the substrate as required by the food packaging structure by manipulating the thin electroconductive material layer, as described in more detail below. Two or more differential productions of thermal energy are possible by selecting the appropriate combination of layers. A variety of possibilities exist to achieve this result.

GENERAL DESCRIPTION OF INVENTION

Figure 1:
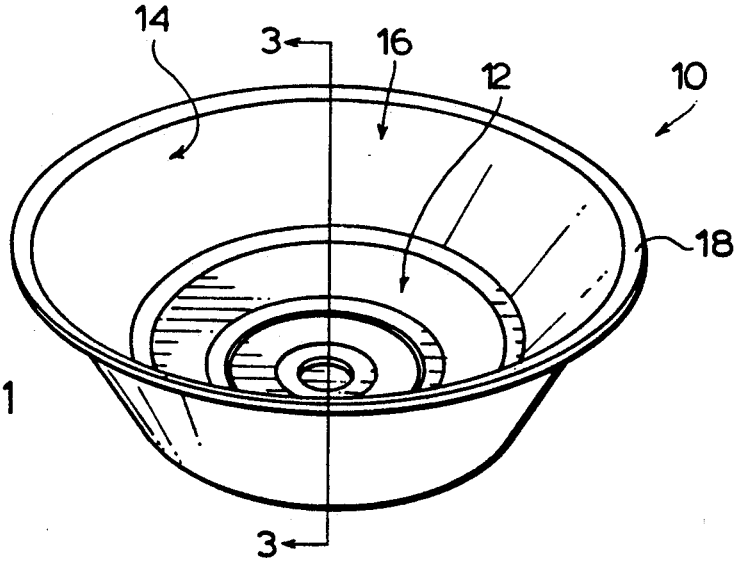
FIG. 1 is a perspective view of a pot pie dish provided in accordance with one embodiment of the invention.

As discussed above, the present invention provides a novel packaging structure wherein differential degrees of thermal heating are obtained from different parts of the package by appropriate choice of the various layers of material within a laminate structure from which the package is formed.

In general, the laminate structure comprises a first outer polymeric film layer corresponding in dimension to the laminate, a second outer structural support layer and a first thin layer of electroconductive material which is sufficiently thin to generate thermal energy when exposed to microwave energy located between said outer layers. In addition, the laminate incorporates means associated with the first thin layer of electroconductive material to result in differential degrees of thermal energy being generated from the laminate upon exposure of the packaging structure to microwave energy.

By term "differential degree of heating" as used herein is meant that thermal energy of different intensity is generated from two or more different locations in the laminate structure, when the packaging structure formed from the laminate is exposed to microwave energy. For most applications, two different levels of thermal energy generation is sufficient but three or more levels of thermal energy may be provided, if desired, following the principles of the invention. By providing differential degrees of heating herein, greater control over the microwave cooking of foodstuffs is achieved, to enable a broader range of food products to be cooked to a fully-cooked condition for consumption.

The differential thermal energy production usually is achieved by the provision at least one additional layer within the laminate. Such additional layer may comprise an additional thin layer of electroconductive material, with one or both layers of electroconductive material being patterned, i.e., being provided in the form of a pattern rather than as a macroscopically-continuous layer.

Such additional layer may comprise a layer of heat-sealable material which is rendered flowable to form a smooth coating upon exposure to laminating temperature, such as a vinyl lacquer. Such layer of heat-sealable material may be continuous or formed in a pattern.

Combinations of additional layers of electroconductive material and of heat-sealable material, selectively continuous or patterned, may be employed for the purpose of achieving the desired heating pattern from the laminate in the packaging material.

References herein to a layer of the laminate being continuous mean that the layer extends for the dimension of the laminate. References herein to a layer of the laminate being patterned mean that the layer is formed in a pattern and, therefore, is not present continuously within the dimensions of the laminate.

The outer polymeric film layer may be any convenient flexible polymeric material which is resistant to breakdown or the high temperatures generated from the laminate structure when exposed to microwave radiation. Suitable materials include polyesters, such as that sold under the trademark "Mylar".

The outer layer of support material is formed of electrically non-conductive structural stock material, so as to provide structural rigidity to the laminate and support for the physical shape of the packaging structure formed from the laminate.

The support layer usually is provided by paper or paperboard of a thickness corresponding to the rigidity required for the end product packaging structure.

The layer of electroconductive material, and any additional layer of such material present in the laminate, most conveniently may be provided by an electroconductive metal or alloy thereof, preferably aluminum or stainless steel, although other electroconductive materials, such as carbon black and certain metal oxides, may be employed.

The layer of electroconductive material may be of any desired thickness capable of converting a portion of microwave energy incident thereon into thermal energy. In effect, the thickness of the electroconductive material is such as to cause that material to become semi-conductive, so that electric currents passing in the electroconductive material layer on exposure to microwave energy generate heat from the resistance of the layer to the current flow. Hereafter, the invention will be described more particularly with the electroconductive material being metal.

For aluminum, which is the metal commonly employed, the thickness generally is one corresponding to an optical density of about 0.08 to about 3.0, preferably about 0.1 to about 0.8 and most preferably about 0.2 to about 0.5. For stainless steel, the thickness generally is one corresponding to a resistance of about 50 to about 5000 ohms, preferably about 100 to about 2000 ohms. Aluminum is most conveniently provided as a layer by vapor deposition while stainless steel is most conveniently provided as a layer by sputtering.

The laminate from which the packaging structure is formed may comprise several different embodiments which employ a plurality of layers of material to achieve the desired differential degrees of heating from the packaging structure.

In one embodiment, the laminate comprises the outer polymeric film layer, the outer support layer, a patterned or continuous thin metal film layer adhered to the outer support layer by a layer of laminating adhesive and a patterned layer of heat-labile material located between the metal layer and the polymeric film layer. Since the heat-sealable material is provided in a pattern, part of the thin metal layer is adhered directly to the polymeric film layer and part is adhered to the layer of heat-sealable material (see FIG. 8 described below).

It has been found that a thin metal-layer produces more thermal energy generation for the same thickness of metal when it is adhered to a heat-sealable layer than when it is adhered directly to a polymeric film layer, so that the laminate produces a greater heat output in the regions of the pattern of heat-labile material than in the regions where such material is absent and the thin metal layer is adhered to the-polymeric film layer. In this regard, reference is made to my copending U.S. patent application Ser. No. 354,217 filed May 19, 1989 now U.S. Pat. No. 4,963,424, the disclosure of which is incorporated herein by reference.

In another embodiment, two thin metal layers are positioned between the outer layers. In this arrangement, one thin metal layer is supported directly on the inner surface of the outer polymeric film layer and the two thin metal layers are separated by a layer of heat-sealable material.

To provide for a differential degree of heating within the laminate, at least one of the three adjacent layers of the first and second thin metal layers and the heat-sealable layer is patterned. Hence, both thin metal layers may be continuous with the heat-sealable layer patterned. In this arrangement, a greater amount of thermal energy is produced by the thin metal layers in the region spaced apart by the pattern of the heat-sealable layer than by the merged metal layers between those regions. In this regard, reference is made to my copending U.S. patent application Ser. No. 374,655 filed Jun. 30, 1989 ("Multi-Met"), the disclosure of which is incorporated herein by reference.

Alternatively, the metal layer supported by the polymeric film layer and the heat-sealable layer may be continuous while the metal layer adhered to the substrate layer by laminating adhesive is patterned. In this arrangement, a greater production of thermal energy occurs in the region of the laminate where there are two overlying metal layers than where there is a single metal layer.

In a variation of the laminate according to this embodiment, an additional layer of laminating adhesive is provided between the thin metal layer supported on the outer polymeric film layer and the heat-sealable layer. In this arrangement, the laminating adhesive layer may be patterned or continuous.

In a further embodiment of the laminate structure, the outer polymeric film layer supports a second continuous thin metal layer which is adhered to an intermediate paper layer by laminating adhesive. The first thin metal layer is adhered to the outer support layer by conventional laminating adhesive and is supported on one side of an intermediate polymeric film layer, which has a third thin metal layer supported on the other side of the intermediate polymeric film layer. The third thin metal layer is adhered to the intermediate paper layer by a layer of laminating adhesive.

At least one of the thin metal layers is provided in a pattern. When one of the metal layers is patterned, a greater heat generation is obtained in regions where there are three overlying metal layers than in regions where there are two overlying metal layers.

When two of the thin metal layers are patterned, then three differential levels of heating are attained from the laminate, depending on whether one (least), two (greater) or three (greatest) metal layers overly each other.

In addition, it is possible to deactivate one or more of the thin metal layers by incorporation of a desired pattern of a material which inhibits the generation of thermal energy from a thin metal layer overlying the material, such as a high surface tension wax material, as more fully described in my copending U.S. Pat. No. 5,039,364 filed Nov. 28, 1989 ("Cool Met"), the disclosure of which is incorporated herein by reference.

By deactivating (i.e. preventing the metal layer from producing thermal energy when exposed to microwave energy), one or more of the metal layers in this way, further differential degrees of heating can be generated from the laminate structure.

It will be apparent to those skilled in the art that variations of these structural embodiments of the invention may be made using coatings, a layer or layers of a continuous or patterned electroconductive material on or sandwiched between electrically non-conductive substrates for the purposes of forming a packaging structure which provides the desired pattern of heating when exposed to microwave energy.

The packaging structure of the invention may be utilized in a variety of products where a differential degree of heating is desirable within the structure. One application of the packaging structure in a pot pie dish.

Many food products are packaged for sale in the form of a pot pie dish, comprising some form of tray formed of card and/or metal foil material, usually in the form of a circular base portion and an upwardly and outwardly-flared side wall to an open top to define a housing for the pot pie, comprising a pot pie filling enclosed within a pie crust.

The foodstuff is heated for consumption, usually in a conventional convection oven. When such foodstuff is heated by conventional convection oven for consumption, while the filling is fully and evenly heated and the pie crust adjacent the walls is browned and crisp, the pie crust at the bottom of the pie tends to be soggy, probably as a result of migration of moisture downwardly during the somewhat extended heating period.

This problem with conventionally reheated pot pies is overcome by incorporating a packaging structure in accordance with the present invention into a pot pie dish, so that a greater degree of thermal energy is generated in the bottom of the dish than in the walls. As a result, the sides and bottom of the pot pie crust are both browned without the bottom becoming soggy. In addition, complete cooking of the contents of the pot pie to the desired temperature for consumption is achieved in a much shorter period of time than is necessary for convection heating.

Accordingly, in one specific embodiment of the present invention, there is provided a pot pie dish or receptacle suitable for microwave heating of a pot pie food product contained therein and comprising a base portion and a side wall portion integrally formed with the base portion and upwardly extending from the base portion to an open top to define, with the base portion, a housing to receive a pot pie food product comprising a crust engaging the side wall portion and the circular base portion and a pot pie filling within the crust.

The receptacle is formed from a laminate of a plurality of layers of material which includes a first polymeric film layer coextensive in dimension with the laminate and providing an inner surface to said receptacle to engage the outer crust of the pot pie; a first thin layer of conductive material coextensive with and supported on an inner surface of the first polymeric film layer and having a thickness effective for conversion of a portion of microwave energy incident thereon to thermal energy; a layer of paperboard material coextensive in dimension with the laminate and providing an outer surface and structural rigidity to the receptacle; and at least one additional thin layer of electroconductive material coextensive with the base portion only of the receptacle and having a thickness effective for conversion of a portion of the microwave energy incident thereon to thermal energy. The at least one additional thin layer of electroconductive material is/are located between the outer card layer and the first thin layer of electroconductive material and is/are spaced therefrom and from each other by at least one spacer layer.

By providing at least one additional thin layer of electroconductive material, generally a metal, most conveniently two additional thin layers of electroconductive material, in the base region of the receptacle, there results a plurality of superimposed thin layers of electroconductive material. In this way, upon exposure of the base portion of the dish to incident microwave energy, thermal energy is produced by the multiple number of thin layers and hence to a greater extent than from the single layer of electroconductive material in the side walls.

By providing for a greater thermal energy production in the base portion of the receptacle by reason of the multiple superimposed layers of electroconductive material, a more even overall browning of the pot pie crust is obtained by the application of microwave energy than was previously obtained. Thermal energy is produced from all the pot pie dish but more intensely from the base portion to produce browning and cooking of the crust in the area which normally tends to be soggy and raw in conventional convection oven cooking.

Another application of the packaging structure is a planar pizza heating board, which is able to achieve a more even heating to the pizza filling while crispening and browning of the crust than has been achievable using thin metallic layers exposed to microwave energy.

Accordingly, in another embodiment of the present invention, there is provided a planar laminate structure particularly adapted for the microwave heating of pizzas for consumption, which comprises multiple layers of material. An outer rigid square paperboard layer provides structural integrity to the laminate structure. A first thin layer of electroconductive material of a thickness such that a portion of microwave energy incident thereon is converted to thermal energy is adhered directly to the paperboard layer by an adhesive layer provided on and of dimension corresponding to that of the paperboard layer. The first thin layer of electroconductive material has the form of an annulus with the outer periphery of the annulus corresponding to the periphery of the pizza intended to be heated using the laminate.

A second thin layer of electroconductive material of a thickness such that a portion of the microwave energy incident thereon is converted to thermal energy is spaced from the first thin layer of electroconductive material by at least one additional layer. The second thin layer of electroconductive material corresponds in dimension to that of the paperboard layer. An outer polymeric film layer on which the second thin layer of electroconductive material is supported and which corresponds in dimension to the paperboard layer completes the structure.

In this arrangement, therefore, there is one thin layer of electroconductive material corresponding in dimension with the planar laminate and an annular thin layer of electroconductive material in a selected region only of the laminate. The provision of the annular layer permits generation of additional thermal energy in that region to assist in browning of the crust and also in obtaining more even heating of the pizza filling upon microwave heating.

The laminates from which the packaging structures of the present invention are formed are provided as planar structures which then are shaped to the desired packaging structure. The particular procedure employed depends on the elements making up the laminate and the intended end use.

Since the packaging structures contemplated are generally small in physical dimensions, so as to fit comfortably into a microwave oven, it is generally economical to form multiple numbers of such laminates at a single run.

For example, for the formation of a laminate suitable for use as a pizza board, the following procedure may be adopted. A web of metallized polymeric film material wherein the metal layer is of a thickness such that incident microwave radiation is partially converted to thermal energy is fed from a source thereof and is coated with a layer of heat-sealable material which is rendered flowable upon exposure to laminating temperature. The heat-sealable material is coated with a second thin layer of electroconductive metal of thickness such that incident microwave energy is partially converted to thermal energy. Selective demetallization of the second thin metal layer then is effected to provide a predetermined pattern of the second thin metal layer on the heat labile layer. The resulting structure then is contacted with a web of paperboard material having a layer of laminating adhesive therein. The outer webs are laminated together with the other layers sandwiched therebetween at a temperature sufficient to cause the heat-sealable layer to flow and form a smooth surface for the second metal layer. The individual pizza reheating boards then may be cut from the continuous roll, such as by die cutting.

DESCRIPTION OF PREFERRED EMBODIMENT

Figure 2:
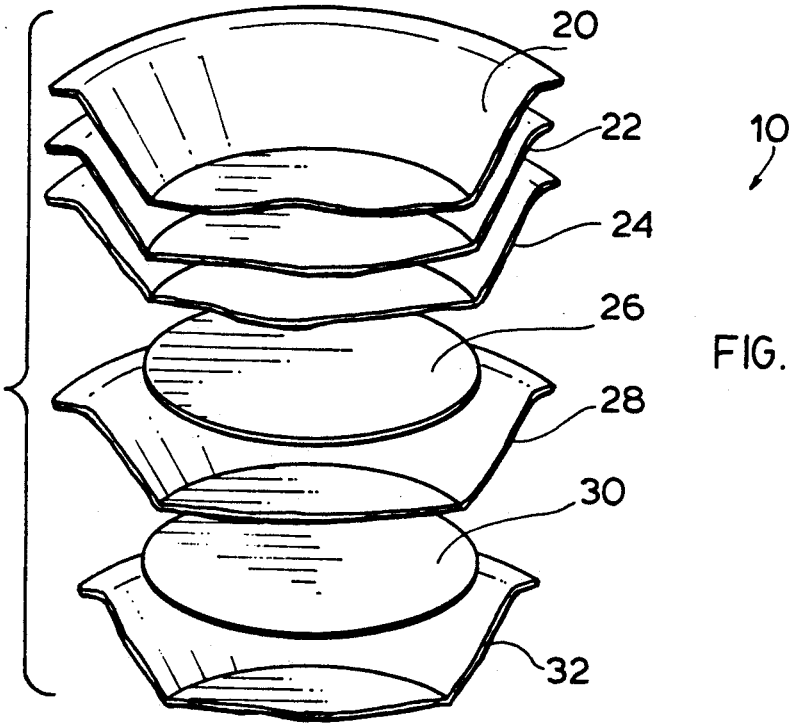
FIG. 2 is an exploded view of the pot pie dish of FIG. 1 illustrating the plurality of layers in the laminate.
Figure 3:
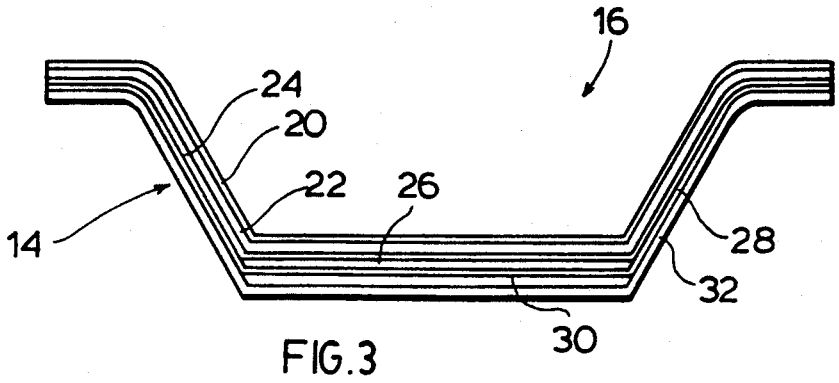
FIG. 3 is a sectional view of the pot pie dish of FIG. 1 taken on line 3—3 of FIG. 1.

Referring first to FIGS. 1 to 3 of the drawings, a pot pie dish 10 comprises a circular base portion 12, and a side wall 14 integral with the base portion and extending upwardly and outwardly from the base portion 12 to define an enclosure 16 for a pot pie. An outwardly horizontally-extended integral rim 18 is provided at the upper extremity of the wall 14. Depending on the foodstuff involved, typically the pot pie in the enclosure 16 has a crust on top as well as at the sides and bottom, to fully enclose the pot pie filling.

FIGS. 2 and 3 illustrates the various layers of material present in the laminate from which the pot pie dish 10 is formed. It will be understood that the described layers are joined together in face-abutting relationship and the thickness of the layers are not shown to scale in the drawings.

The laminate comprises an inner polymeric film layer 20 which is engaged by the side and bottom pie crust of the pot pie. Adjacent the polymeric film layer 20 is a first thin metal layer 22 which is coextensive with the polymeric film layer. The metal layer 22, which usually is aluminum but which may be any other convenient electroconductive material, is provided with a thickness such that a portion of microwave energy incident thereon is converted into thermal energy.

The thickness of metal necessary to achieve this result depends on the metal chosen. For the preferred aluminum, a thickness corresponding to an optical density of about 0.08 to about 2.0 produces the required conversion of microwave energy to thermal energy.

As the thickness of the metal layer increases, the thermal energy produced therefrom increases to a maximum, which for aluminum is at an optical density of about 0.8. Increasing the thickness of the metal beyond this value does not increase the thermal output but initiates a shielding effect, whereby a portion of the incident microwave energy not converted to thermal energy is prevented from passing through the metal.

This shielding effect has the result that the foodstuff does not heat up as quickly. This is often an advantage with a pot pie, where it is possible the filling may be cooked before the crust has been browned. It may be desirable, therefore, to provide a shielding effect at the sides of the pot pie.

The next inner layer is a layer of paper 24 which is coextensive with the polymeric film layer 20 and the first metal layer 22.

A second thin metal layer 26 is provided in the region of the base portion 12 only of the pot pie dish 10. The second thin metal layer 26, which usually is aluminum but which may be any other convenient electroconductive material, is provided with a thickness such that microwave energy incident thereon is converted to thermal energy. Usually, the second metal layer 26 is of the same thickness as metal layer 22, but may differ therefrom, if desired.

A second polymeric film layer 28 is provided coextensive with the paper layer 24, so that, in the region of the base portion 12, the second metal layer 26 is sandwiched between the paper layer 24 and the second polymeric film layer 28, while in the region of the wall portion 14, the layers 24 and 28 abut each other.

A third thin metal layer 30 is provided in the region of the base portion 12 only of the pot pie dish 10. The third thin metal layer 30, which usually is aluminum but which may be any other convenient electroconductive material, is provided with a thickness such that microwave energy incident thereon is converted to thermal energy. Usually, the third metal layer 30 is of the same thickness as metal layers 22 and 26, but may differ therefrom, if desired.

Finally, an outer light cardboard layer 32 is provided coextensive with the second polymeric film layer 28, so that, in the region of the base portion 12, the third thin metal layer 30 is sandwiched between the outer cardboard layer 32 and the second polymeric film layer 28 and, in the region of the wall portion 14, the outer cardboard layer 32 abuts the second polymeric film layer 28.

The outer cardboard layer 32 is of a thickness at least sufficient to provide structural strength to the laminate and yet permits stamping or molding of the laminate to the shape of the pot pie 10.

The pot pie dish 10 is formed from a flat sheet of the laminate structure by any convenient shaping operation, such as stamping or molding. The laminate may be assembled in any convenient manner from the individual layers or certain combinations of layers.

In one convenient procedure, the first thin metal layer 22 is provided supported on the first polymeric film layer 20, which usually is a polyester. Such products are commercially available. An aluminum layer 22 is conveniently applied to the polymeric film layer 20 by vapor deposition. This combination then may be laminated to the paper layer 24 by any convenient laminating procedure, such procedures being well known t the art.

The second and third metal layers 26 and 30 are supported on the second polymeric film layer 28, which usually is a polyester. This combination is provided by taking a polymeric film layer which has an aluminum layer deposited on both sides and then selectively demetallizing the aluminum from both faces of the polymeric film layer to provide the desired thin metal layers 26 and 30. Such demetallizing may be effected using any suitable etchant, such as aqueous sodium hydroxide for aluminum. One of the procedures described in U.S. Pat. Nos. 4,398,994, 4,552,614, 4,610,755 and 4,685,997, the disclosures of which are incorporated herein by reference, may be employed.

The combination of the metal layers 26 and 30 supported on the polymeric film layer 28 then is laminated by any convenient laminating procedure between the paper layer 24 and the outer card layer 32 to provide the laminate structure.

For economy of manufacture, the laminate usually is formed in a sheet containing a plurality of blanks for the pot pie dish 10, which are individually stamped out and shaped.

Figure 4:
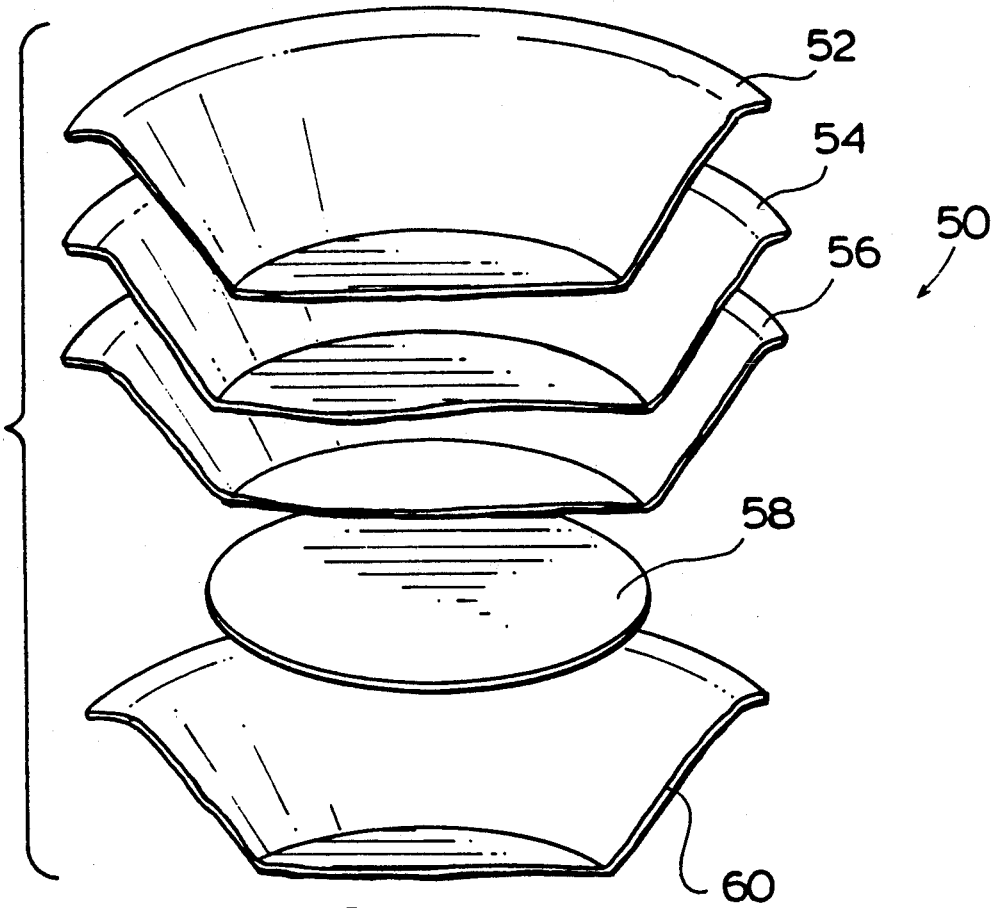
FIG. 4 is an exploded view of the layers of the laminate structure of an alternative form of the pot pie dish.

In FIG. 4, an alternative structure of pot pie dish 50 is shown wherein only two thin metal layers are provided. Both metal layers are of a thickness which causes a portion of microwave energy incident thereon to be converted to thermal energy. As shown therein, there is provided a laminate of an inner polymeric film layer 52, a first thin metal layer 54, a lacquer layer 56, a second thin metal layer 58 and an outer thin card layer 60. As in the case of the embodiment of FIG. 1, the second thin metal layer is dimensioned to correspond only to the base portion of the dish 50, to provide for additional heating in this region, as described above.

The arrangement of FIG. 4 is more economical than that of FIGS. 1 to 3, since it involves much fewer layers.

Figure 5:
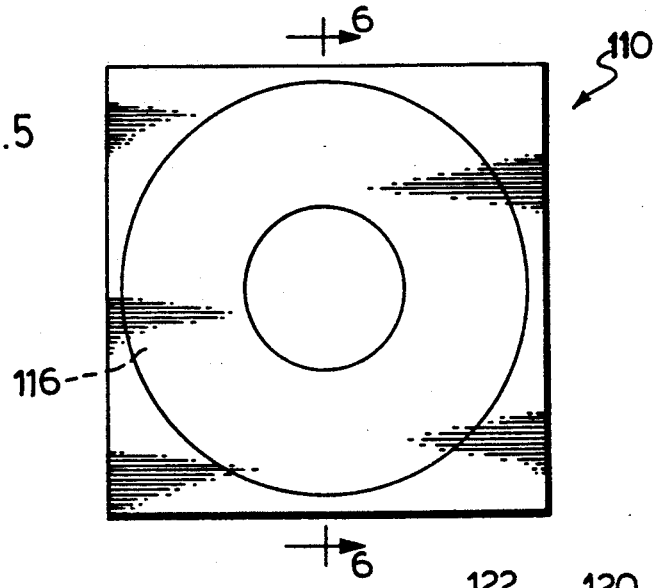
FIG. 5 is a plan view of a pizza board provided in accordance with another embodiment of the invention.
Figure 6:
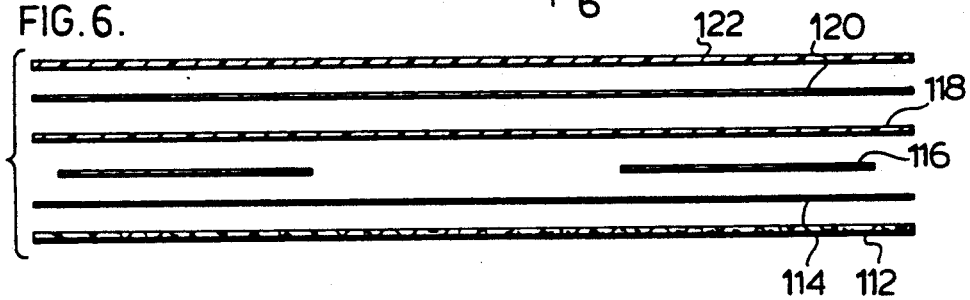
FIG. 6 is an exploded sectional view of the pizza board of FIG. 1, taken on line 2—2 of FIG. 1.

Referring now to FIGS. 5 and 6 of the drawings, a pizza heating board 110 useful for the rapid microwave heating of frozen pizzas for consumption takes the form of a planar article of square configuration and dimensioned to receive a pizza to be reheated on an upper surface thereof.

The pizza heating board 110 comprises a plurality of layers laminated together into a coherent structurally-rigid structure. FIG. 6 shows the plurality of layers in exploded view for clarity. An outer bottom layer 112 of paperboard provides structural rigidity to the laminate. The paperboard layer may be of any convenient thickness providing the required structural stability, generally ranging from about 5 point to about 25 point.

A layer of laminating adhesive 114 is provided coincident in dimension with the paperboard layer 112 to enable the paperboard layer to be adhered to the remaining layers. The laminating adhesive layer 114 may be provided by any of the well-known laminating adhesives.

A first thin metal layer 116 in the form of an annulus is provided. The first thin metal layer 116 may be formed of any electroconductive metal and is of a thickness such that at least a portion of microwave energy incident thereon is converted into thermal energy.

The most convenient metal is aluminum, although stainless steel or copper also may be used, among others. The thickness of the metal layer necessary to produce the thermal energy depends on the metal chosen. For aluminum, a thickness corresponding to an optical density of about 0.08 to about 0.8, preferably about 0.2 to 0.3, may be employed.

The thin metal layer 116 may be provided in its annular form by deposition of a thin metal layer over the whole surface of the adhesive layer 114 and then selectively demetallizing the metal, for example, using an aqueous etchant in one of the procedures set forth in U.S. Pat. Nos. 4,398,994, 4,552,614 and 4,610,755, the disclosures of which are incorporated herein by reference, to remove unwanted metal from the adhesive layer 114 and leave the metal annulus. Alternatively, and more preferably, the metal is formed on a layer of heat-sealable release material and then selectively 118 demetallized from that layer.

A layer 118 of release material is provided, formed of material which will flow during lamination to provide a very smooth surface for the thin metal layer 116. As a result a greater heat output is obtained from that metal layer than if it is supported on a polymeric film layer.

A second thin metal layer 120 corresponds in dimension to that of the pizza board 110 and is supported on the underface of an upper polymeric film layer 122. The second thin metal layer may be formed of an electroconductive metal and is of a thickness such that at least a portion of microwave energy incident thereon is converted into thermal energy. The thickness depends on the metal chosen.

The most convenient metal is aluminum and, for aluminum, the thickness of metal layer necessary to produce the thermal energy corresponds to an optical density of about 0.08 to about 0.8, preferably about 0.2 to 0.3. The thickness of metal used in the second metal layer 128 may be the same as or different from that of the metal in the first metal layer 116.

In the laminate structure of the pizza heating board 110, two overlying thermal energy generating metal layers 116 and 120 are provided in the region of the annular first metal layer 116, while only a single thermal energy-generating metal layer 120 is provided elsewhere in the structure. The effect of this arrangement is to generate more thermal energy in the region of the annulus 116 than elsewhere in the structure to achieve a more even heating of the pizza and crispening and browning of the crust when a frozen pizza is placed on the pizza heating board 110 in a microwave oven.

Figure 7:
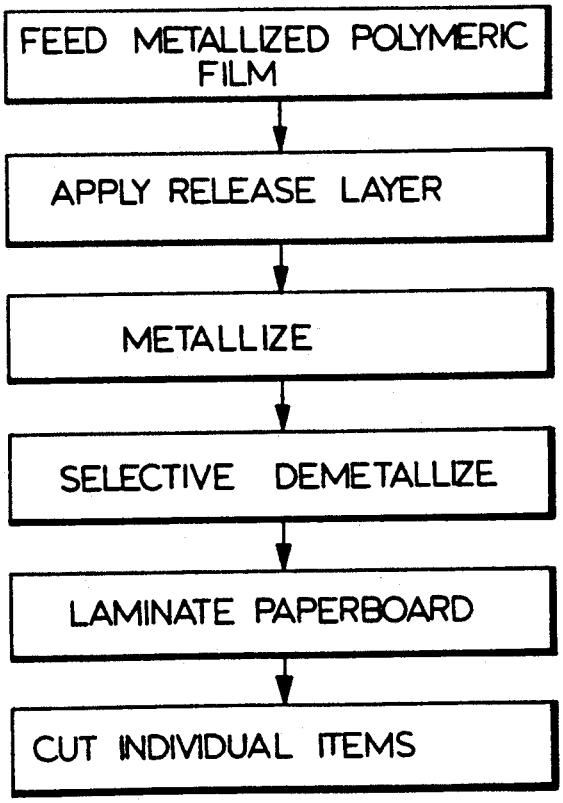
FIG. 7 is a schematic flow sheet of the sequence of steps to form the laminate of FIG. 1.

A typical procedure for formation of the pizza board 110 is shown in FIG. 7. A plurality of such pizza heating boards is formed in a continuous run and individual boards 110 then are cut or punched from the resulting roll.

A web of metallized polymeric film, intended to provide layers 120 and 122 in the pizza heating board 110 is fed past a release-layer applying station whereat a layer of heat-sealable release material is applied over the metal on the metallized web, to provide layer 118.

The web next passes through a metallizing station whereat a thin metal layer is applied over the release layer. This thin metal layer subsequently is subjected to demetallization to leave the annular metal layer 116. The demetallized web then is brought into engagement with a paperboard web having laminating adhesive applied thereto, to provide layers 112 and 114, and the webs then are laminated together in a laminating machine to provide a laminated structure comprising a multiple number of the boards. The individual boards then are cut from the laminated webs.

EXAMPLE

Figure 8:
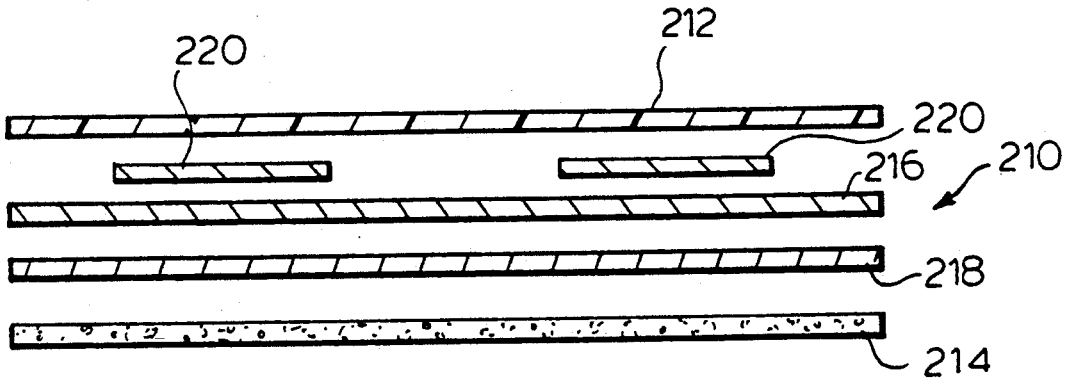
FIG. 8 is an exploded sectional view of a laminate structure in accordance with one embodiment of the invention.

In FIG. 8, there is illustrated an exploded view of a laminate structure provided in accordance with one embodiment of the invention. As seen therein, a laminate 210 comprises a first outer layer 212 of polymeric film and a second outer layer 214 of paperboard to provide structural rigidity to the laminate. A thin layer 216 of electroconductive metal is provided adhered to the second outer layer 214 by a layer of laminating adhesive 218. A patterned layer 227 of lacquer material is provided between the first outer layer 212 and the thin metal layer 216. It will be seen that the thin metal layer is adhered to the first outer layer 212 in regions thereof not overlaid by the pattern layer 220 of lacquer.

A commercial chicken pot pie was cooked in a conventional convection oven following the instructions on the packet, namely a cooking time of 38 minutes at 400° F. The pot pie was supplied in a foil dish. When cooked the sides of the pot pie had a browned crisp crust but the bottom of the pie was soggy.

The same commercial pot pie was removed from its foil tray and located in a pot pie dish constructed as illustrated in FIGS. 1 to 3, in which the thin metal layers were aluminum with an optical density of 0.3. The pie was cooked in a 700 watt Panasonic microwave oven for 6½ minutes on high. The bottom crust of the pie was not soggy but browned, as were the side crust.

SUMMARY OF DISCLOSURE

In summary of this disclosure, the present invention provides a variety of packaging structures which is able to provide differential degrees of thermal heating from incident microwave energy for the purpose of achieving beneficial effects in the heating of foodstuffs by microwave energy. Modifications are possible within the scope of this invention.

What I claim is:

1. A packaging structure for microwave cooking of foodstuffs packaged therein and formed from a laminate structure, comprising:

a first outer layer of polymeric film corresponding in dimension to the laminate structure, a second outer layer of structural support material corresponding in dimension to the laminate structure, a first thin layer of electroconductive material between said first and second outer layers and having a thickness effective to permit a portion of microwave energy incident thereon to be converted to thermal energy, and means operatively associated with said first thin layer of electroconductive material to effect a generation of differential degrees of thermal energy from the laminate structure upon exposure of said packaging structure to microwave energy.

2. The packaging structure of claim 1 wherein said electroconductive material is a metal.

3. The packaging structure of claim 2 wherein said metal is aluminum.

4. The packaging structure of claim 3 wherein said aluminum has a thickness corresponding to an optical density of about 0.08 to about 3.0.

5. The packaging structure of claim 4 wherein said optical density is about 0.1 to about 0.8.

6. The packaging structure of claim 5 wherein said optical density is about 0.2 to about 0.5.

7. The packaging structure of claim 2 wherein said metal is stainless steel.

8. The packaging structure of claim 7 wherein said stainless steel has a thickness corresponding to a resistance of about 50 to about 5000 ohms.

9. The packaging structure of claim 8 wherein said resistance is about 100 to about 2000 ohms.

10. A packaging structure for microwave cooking of foodstuffs packaged therein and formed from a laminate structure, comprising:

a first outer layer of polymeric film corresponding in dimension to the laminate structure, a second outer layer of structural support material corresponding in dimension to the laminate structure.

a first thin layer of electroconductive metal adhered to said second outer layer and having a thickness effective to permit a portion of microwave energy incident thereon to be converted to thermal energy, and a layer of a heat-sealable material which is rendered flowable to a smooth layer when exposed to laminating temperature located between said first thin layer of electroconductive metal and said first outer layer and provided in the form of a pattern, said first thin layer of electroconductive metal being adhered to said first outer layer in regions thereof not overlaid by the pattern layer of heat-sealable material, whereby, upon exposure of said laminate structure to microwave energy, a greater degree of thermal energy is generated from said first thin layer of electroconductive metal in regions where said first thin layer of electroconductive metal is adhered to said heat-sealable material than is generated from said first thin layer of electroconductive metal in regions where said first thin layer of electroconductive metal is adhered to said first outer layer.

11. The packaging structure of claim 10 wherein said metal layer is macroscopically continuous.

12. The packaging structure of claim 10 wherein said metal layer is provided in the form of a pattern.

13. A packaging structure for microwave cooking of foodstuffs packaged therein and formed from a laminate structure, comprising:

a first outer layer of polymeric film corresponding in dimension to the laminate structure, a second outer layer of structural support material corresponding in dimension to said laminate structure, a first thin layer of electroconductive metal adhered to said first outer layer and having a thickness effective to permit a portion of microwave energy incident thereon to be converted to thermal energy, a second thin layer of electroconductive metal adhered to said second outer layer and having a thickness effective to permit a portion of microwave energy incident thereon to be converted to thermal energy, and a separating layer located between and adhered to both said first and second layers of electroconductive metal, one of said first and second layers of electroconductive metal and said separating layer being formed in a pattern, whereby, upon exposure of said laminate structure to microwave energy, a greater degree of thermal energy is produced from regions where there are two overlying metal layers spaced apart by said separating layer than elsewhere.

14. The packaging structure of claim 13 wherein said separating layer is a layer of heat-sealable material which is rendered flowable to a smooth surfaced layer upon exposure to laminating temperatures.

15. The packaging structure of claim 14 wherein both of said first and second thin metal layers are macroscopically continuous and said separating layer is formed into a pattern, whereby a greater degree of thermal energy is produced by overlying thin metal layers in a region spaced apart by the pattern of heat-readable material than by merged metal layers between said region.

16. The packaging structure of claim 14 wherein said first thin metal layer is macroscopically continuous, said separating layer is continuous and said second metal layer is formed into a pattern, whereby a greater degree of thermal energy is produced by the thin metal layers in the region where there are two overlying metal layers than in the region where there is a single metal layer.

17. The packaging structure of claim 16 wherein a layer of laminating adhesive is provided between the first metal layer and the said separating layer.

18. The packaging structure of claim 17 wherein said layer of laminating adhesive is patterned.

19. A packaging structure for microwave cooking of foodstuffs packaged therein and formed from a laminate structure, comprising:

a first outer layer of polymeric film corresponding in dimension to the laminate structure, a first thin layer of electroconductive metal adhered to said first outer layer of polymeric film and having a thickness effective to permit a portion of microwave energy incident thereon to permit a portion of microwave energy incident thereon to be converted to thermal energy, an intermediate layer of structural support material corresponding in dimension to the laminate structure and adhered to said first thin layer of electroconductive metal, an intermediate layer of polymeric film material corresponding in dimension to the laminate structure, a second and a third thin layer of electroconductive metal adhered one to each face of said intermediate layer of polymeric film and having a thickness effective to permit a portion of microwave energy incident thereon to be converted to thermal energy, said second metal layer of electroconductive metal being adhered to said intermediate layer of structural support material, and a second outer layer of structural support material adhered to said third thin layer of electroconductive metal, at least one of said first, second and third thin layer of electroconductive metal being formed into a pattern whereby a greater degree of thermal energy is produced from a region of three overlying metal layers than is produced by a region of two overlying metal layers which in turn is greater than is produced by a region of a single metal layer.

20. A packaging structure of claim 19 wherein two of said first, second and third metal layers are provided in a pattern, whereby three differential degrees of heating are attained.

21. A receptacle suitable for microwave heating of a pot pie food product contained therein, comprising:

a base portion, and a side wall portion integrally formed with said base portion and extending upwardly from said base portion to an open top to define with the base portion a housing to receive a pot pie product comprising an outer crust engaging the side wall portion and the base portion and a pot pie filling within the crust, said base portion and side wall portion of said receptacle being formed from a laminate of a plurality of layers of material, comprising:

a first polymeric film layer coextensive in dimension with the laminate and providing an inner surface to said receptacle to engage the outer crust of said pot pie, a first thin layer of electroconductive material coextensive with and supported on an inner surface of said first polymeric film layer and having a thickness effective for conversion of a portion of microwave energy incident thereon to thermal energy, a layer of paperboard material coextensive in dimension with the laminate and providing an outer surface and structural rigidity to said receptacle, and at least one additional thin layer of electroconductive material coextensive with only said base portion of said receptacle and having a thickness effective for conversion of a portion of microwave energy incident thereon to thermal energy, said at least one additional thin layer of electroconductive material being located between said layer of paperboard material and said first thin layer of electroconductive material and being spaced from said first thin layer of electroconductive material by at least one spacer layer.

22. The receptacle of claim 21 wherein an additional thin layer of electroconductive material is provided and said additional thin layer being coextensive in dimension with only said base portion of the receptacle and supported on one face of a second polymeric film layer which is coextensive in dimension with the laminate.

23. The receptacle of claim 21 wherein each said thin layer of electroconductive material is aluminum and has a thickness corresponding to an optical density of about 0.08 to about 2.0.

24. The receptacle of claim 22 wherein each said thin layer of electroconductive material is aluminum and has a thickness corresponding to an optical density of about 0.08 to about2.0.

25. The receptacle of claim 24 wherein each said thin aluminum layers has the same thickness.

26. The receptacles of claim 24 wherein each said thin layer of electroconductive material is aluminum, said first thin layer has a thickness corresponding to an optical density of aluminum about 0.08 to about 2.0 and said two additional thin layers has a thickness corresponding to an optical density of aluminum of about 0.08 to about 0.8.

27. The receptacle of claim 22 wherein said first polymeric film layer is laminated to a paper layer and said second polymeric film layer is laminated between said paper layer and said outer layer of paperboard material.

28. The receptacle of claim 21 wherein a single additional layer of electroconductive material is provided.

29. A planar laminate structure adapted for microwave heating of a pizza having a periphery, which comprises:

an outer rigid square paperboard layer providing structural rigidity to the laminate structure, a first thin layer of electroconductive material, having a thickness whereby a portion of microwave energy incident thereon is converted to thermal energy, adhered directly to said paperboard layer by an adhesive layer provided on and of dimension corresponding to said paperboard layer, said first thin layer of electroconductive material is in the form of an annulus having an outer periphery corresponding to the periphery of the pizza intended to be heated using the laminate structure, a second thin layer of electroconductive material having a thickness whereby a portion of microwave energy incident thereon is converted to thermal energy and spaced from said first thin layer of electroconductive material by at least one additional layer, said second thin layer of electroconductive material corresponding in dimension to that of said paperboard layer, and an outer polymeric film layer on which said second thin layer of electroconductive material is supported and corresponding in dimension to that of said paperboard layer.

30. The laminate structure of claim 29, wherein said at least one additional layer is provided by a layer of heat-sealable material which is rendered flowable to provide a smooth surface when exposed to laminating temperature.

31. The laminate structure of claim 29 wherein said paperboard layer has a thickness from about 5 point to about 25 point.

32. The laminate structure of claim 30 wherein said first and second thin layers of electroconductive material are formed of aluminum and said aluminum has a thickness corresponding to an optical density of about 0.08 to about 0.8.

33. The laminate structure of claim 32 wherein said aluminum has a thickness corresponding to an optical density of about 0.2 to about 0.3.

34. A method of forming a laminate structure, which comprises:

feeding a web of polymeric film material whereon there is provided a thin layer of electroconductive material having a thickness whereby incident microwave energy is partially converted to thermal energy, coating said thin layer of electroconductive material with a layer of a heat-sealable material which is rendered flowable upon exposure to laminating temperatures, coating said heat-sealable material layer with a second thin layer of electroconductive metal of a thickness whereby incident microwave energy is partially converted to thermal energy, effecting selective demetallization of said second thin metal layer to provide a predetermined pattern of said second thin metal layer of said heat-sealable layer to form a structure, contacting said structure with a web of paperboard material having a layer of laminating adhesive thereon, and laminating said web of polymeric film material and of paperboard material with said first and second layers of electroconductive metal and said layer of heat-sealable material sandwiched therebetween at a temperature effective to cause said heat-sealable layer to flow and form a smooth surface for said second metal layer.

35. The method of claim 34 wherein said pattern of thin metal layer comprises a plurality of annuli of metal.

* * * * *